US011492190B2

(12) United States Patent
Nakano

(10) Patent No.: US 11,492,190 B2
(45) Date of Patent: Nov. 8, 2022

(54) FOOD PRODUCTS AND METHODS OF PREPARING THE SAME

(71) Applicant: MONOSOL, LLC, Merrillville, IN (US)

(72) Inventor: Ichiro Nakano, Tokyo (JP)

(73) Assignee: MONOSOL, LLC, Merrillville, IN (US)

( * ) Notice: Subject to any disclaimer, the term of this patent is extended or adjusted under 35 U.S.C. 154(b) by 0 days.

(21) Appl. No.: 15/736,159

(22) PCT Filed: Jul. 6, 2016

(86) PCT No.: PCT/US2016/041023
§ 371 (c)(1),
(2) Date: Dec. 13, 2017

(87) PCT Pub. No.: WO2017/007779
PCT Pub. Date: Jan. 12, 2017

(65) Prior Publication Data

US 2018/0186549 A1 Jul. 5, 2018

Related U.S. Application Data

(60) Provisional application No. 62/190,693, filed on Jul. 9, 2015.

(51) Int. Cl.
*B65D 81/32* (2006.01)
*B65D 65/46* (2006.01)
(Continued)

(52) U.S. Cl.
CPC ..... *B65D 81/3238* (2013.01); *B65D 65/463* (2013.01); *B65D 81/3415* (2013.01);
(Continued)

(58) Field of Classification Search
None
See application file for complete search history.

(56) References Cited

U.S. PATENT DOCUMENTS 4,987,280 A 1/1991 Kanafani et al.
2001/0037872 A1* 11/2001 Sabin ..... A47J 36/28 165/10

(Continued)

FOREIGN PATENT DOCUMENTS

CN 1125681 7/1996
CN 1255451 6/2000

(Continued)

OTHER PUBLICATIONS

Solo Boss Lady, IndoMie Instant Noodles—Mi Goreng, Journey into the World of Ramen, <http://ramenlovers.blogspot.com/2005/12/indomie-instant-noodles-mi-goreng.html> (Year: 2005).*

(Continued)

*Primary Examiner* — Erik Kashnikow
*Assistant Examiner* — Thanh H Nguyen
(74) *Attorney, Agent, or Firm* — Marshall, Gerstein & Borun LLP

(57) ABSTRACT

A packaged product is disclosed that includes a cooking container, a first food product, and a packet filled with a second food product. The cooking container may have a sealed interior volume, and the first food product and the packet may be disposed within the sealed interior volume. The packet may be made of a water-soluble film that is edible. Also disclosed is a method of preparing an instant food product for consumption. The method may include removing a lid from a cooking container containing both a first food product and a packet filled with a second food product. The method may further include adding water to the cooking container to submerge and dissolve the packet.

23 Claims, 2 Drawing Sheets

(51) Int. Cl.
*B65D 81/34* (2006.01)
*B65D 85/816* (2006.01)

(52) U.S. Cl.
CPC ..... *B65D 81/3453* (2013.01); *B65D 81/3461* (2013.01); *B65D 85/816* (2013.01); *B65D 2581/3404* (2013.01); *B65D 2581/3405* (2013.01); *B65D 2581/3422* (2013.01); *B65D 2581/3432* (2013.01)

(56) References Cited

U.S. PATENT DOCUMENTS

| | | | | |
|---|---|---|---|---|
| 2005/0118217 | A1* | 6/2005 | Barnhart | A61K 9/006 424/401 |
| 2006/0081134 | A1 | 4/2006 | Ozawa | |
| 2008/0152768 | A1* | 6/2008 | Lan | B65D 85/816 426/125 |
| 2008/0292754 | A1 | 11/2008 | Katada et al. | |
| 2009/0291282 | A1 | 11/2009 | Kitamura et al. | |
| 2010/0068350 | A1* | 3/2010 | Shen | A23C 19/086 426/96 |
| 2010/0221309 | A1* | 9/2010 | Myers | A61K 8/0208 424/443 |
| 2012/0288590 | A1* | 11/2012 | Soane | A23L 13/03 426/92 |
| 2013/0273277 | A1* | 10/2013 | Lee | B32B 27/42 428/35.2 |
| 2013/0305931 | A1* | 11/2013 | Pattison | A47J 31/18 99/295 |
| 2014/0199460 | A1 | 7/2014 | Lee et al. | |
| 2014/0356603 | A1 | 12/2014 | Kumar et al. | |

FOREIGN PATENT DOCUMENTS

| | | | | |
|---|---|---|---|---|
| CN | 101088879 | | 12/2007 | |
| CN | 101203551 | A | 6/2008 | |
| CN | 104071481 | A | 10/2014 | |
| CN | 204341719 | U * | 5/2015 | |
| JP | S49086188 | A | 8/1974 | |
| JP | S6183887 | U | 6/1986 | |
| JP | H11-137396 | A | 5/1999 | |
| JP | 3074057 | U | 12/2000 | |
| JP | 2002177138 | A | 6/2002 | |
| JP | 2008-074432 | A | 4/2008 | |
| JP | 2013060207 | A | 4/2013 | |
| KR | 20090007671 | U | 7/2009 | |
| KR | 20100001163 | U | 2/2010 | |
| WO | WO-2016132369 | A1 * | 8/2016 | B65B 61/184 |

OTHER PUBLICATIONS

"Droplet." Merriam-Webster.com Dictionary, Merriam-Webster, https://www.merriam-webster.com/dictionary/droplet. Accessed Jan. 31, 2020. (Year: 2020).*

International Search Report and Written Opinion of the International Searching Authority for Application No. PCT/US2016/041023, dated Sep. 19, 2016.

Chinese Patent Application No. 201680040573.4, Notification of the First Office Action, dated Nov. 30, 2018.

Chinese Patent Application No. 201680040573.4, Notification of the Second Office Action, dated Jul. 18, 2019.

Japanese Patent Application No. 2017-568169, Notice of Reasons for Refusal, dated Jun. 29, 2020.

"Chinese Noodle Culture Ceremony", Wang Zhongwang, Beijing, Economic Daily Press, Jan. 31, 2005, pp. 1035-1036.

Chinese Patent Application No. 201680040573.4, Notification of the Fourth Office Action, dated Dec. 4, 2020.

Japanese Patent Application No. 2017568169, Notice of Reasons for Refusal, dated Jan. 4, 2021.

Chinese Patent Application No. 201680040573.4, Decision of Rejection, dated May 6, 2021.

Chinese Patent Application No. 201680040573.4, Office Action, dated Oct. 29, 2021.

Japanese Patent Application No. 2017-568169, Office Action, dated Aug. 10, 2021.

* cited by examiner

FOOD PRODUCTS AND METHODS OF PREPARING THE SAME

CROSS-REFERENCE TO RELATED APPLICATION

This is the United States national phase of International Application No. PCT/US2016/041023, having an international filing date of Jul. 6, 2016, which claims the priority benefit of U.S. Patent Application No. 62/190,693, filed Jul. 9, 2015. The contents of each of the foregoing are expressly incorporated herein by reference.

FIELD OF THE DISCLOSURE

The present disclosure generally relates to packaged food products, and more particularly, instant food products including a flavoring or cooking agent that, during cooking, is released and mixed with the other contents of the instant food product.

BACKGROUND

Instant food products generally include a dehydrated food product having a relatively long shelf life and which can be cooked in a relatively short period of time (e.g., a few minutes) by adding hot or boiling water. Many instant food products package the dehydrated food product together with one or more ingredients to improve the taste and/or cooking characteristics of the dehydrated food product. Examples of such ingredients include powdered seasonings, liquid seasonings, oil, and other flavoring and cooking agents.

If stored in direct contact with the dehydrated food product, the ingredients have the potential to shorten the shelf life of the dehydrated food product. To keep the dehydrated food product and the ingredients separate prior to use, the ingredients usually are encapsulated within a packet which provides a barrier between the ingredients and the dehydrated food product.

Conventional packets are typically made of an inedible, water-insoluble material. Consequently, the consumer must tear open, empty, and discard the packet prior to cooking. Performing these tasks is burdensome and diminishes the convenience of the instant food product. In some cases, the consumer may even be required to use scissors to cut open the packet. Moreover, requiring the consumer to tear or cut open the packet increases the likelihood that the ingredients will be spilled.

The present disclosure sets forth instant food products and methods of their preparation that address one or more of the challenges or needs mentioned above.

SUMMARY

One aspect of the present disclosure includes a packaged product comprised of a cooking container, a first food product, and a packet filled with a second food product. The cooking container may have an interior volume, and the first food product and the packet may be disposed within the sealed interior volume. The packet may be made of a film that is both water-soluble film and edible.

Another aspect of the present disclosure provides a method of preparing an instant food product for consumption. The method may include removing a lid from a cooking container containing a first food product and a packet filled with a second food product. The packet may be made of a water-soluble film that is edible. The method may further include adding water to the cooking container to submerge and dissolve the packet.

DETAILED DESCRIPTION

Disclosed herein are packaged food products, including instant food products, and methods of preparing such products for human and/or animal consumption. In general, the packaged food products according to the present disclosure include a cooking container having a sealed interior volume and containing at least two food products capable of being sealed. One of the food products may be a dehydrated food product, such as instant noodles or instant rice, which can be regenerated relatively quickly (e.g., within a few minutes or seconds) by the addition of a fluid such as hot or boiling water or even cold or room temperature water. The other food product may be a flavoring agent, such as seasonings, that modifies the taste of the dehydrated food product and/or a cooking agent, such as oil or butter, that modifies the cooking properties of the dehydrated food product. To keep the food products separate from each other during storage and distribution, the flavoring and/or cooking agent may be encapsulated within a packet. The packet may be made of water-soluble material so that the packet dissolves and releases its contents when water is added to the cooking container. This alleviates the consumer from having to cut or tear open the packet, thereby improving convenience to the consumer and reducing the likelihood that the packet contents are spilled outside the packaged product. In addition to being water-soluble, the packet material may be edible, and even flavorless (at least to humans), so that the packet has little or no impact on the taste of the cooked food product. Furthermore, the packet may be positioned between the dehydrated food product and a bottom of the container so that the packet is obscured from view. Arranging the packet out of sight reduces the likelihood that consumers will attempt to unnecessarily tear or cut open the packet.

Each of the foregoing elements of the packaged food product, and methods of its preparation, will now be described in more detail.

Figure 1:
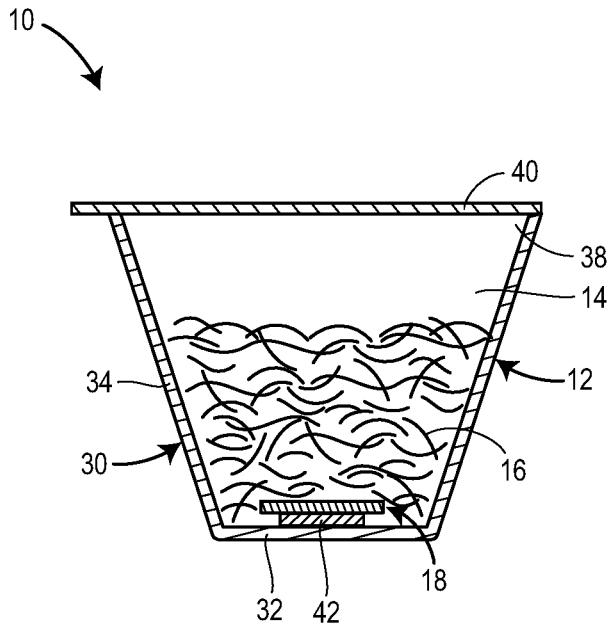
FIG. 1 is a cross-sectional view of one embodiment of a packaged product 10 constructed in accordance with principles of the present disclosure.

FIG. 1 is a cross-sectional view of an embodiment of a packaged food product 10 constructed in accordance with principles of the present disclosure. The packaged food product 10 includes a cooking container 12 defining an interior volume 14, a first food product 16 disposed within the interior volume 14, a packet 18 disposed within the interior volume 14, and a second food product 20 (see FIG. 3) sealed within the packet 18. In at least one embodiment, the first and second food products 16 and 20 are different substances. More than one packet (e.g., two, three, four, or five packets, etc.) may be included in the cooking container 12, and each of the packets may contain the same or a different food product, for example. The packaged food product 10 may be sold as a standalone item, or in bulk with plurality of other packaged food products, in which case the packaged food products may be stowed in secondary packaging such as a crate or box (not illustrated).

The cooking container 12 may include a body 30 having a generally flattened bottom wall 32, so that the cooking container 12 can rest on a flat surface without inadvertently falling over or rolling away. The body 30 may also have an annular sidewall 34 which extends upwardly from the bottom wall 32 and terminates at a rim 36 (see FIG. 2). The rim 36 may define an opening 38 in the top of the cooking container 12, which allows a consumer to add water or other liquids to the interior volume 14 for cooking purposes, as well as insert a utensil to remove the food products 16 and 20 for eating. To seal closed the interior volume 14 of the cooking container 12 prior to use, a removable lid 40 may attach to and/or sealingly engage the rim 36. The removable lid 40 may be adhered to the rim 36 by an adhesive which allows the consumer to tear away the removable lid 40 without causing damage or permanent deformation to the body 30.

Figure 2:
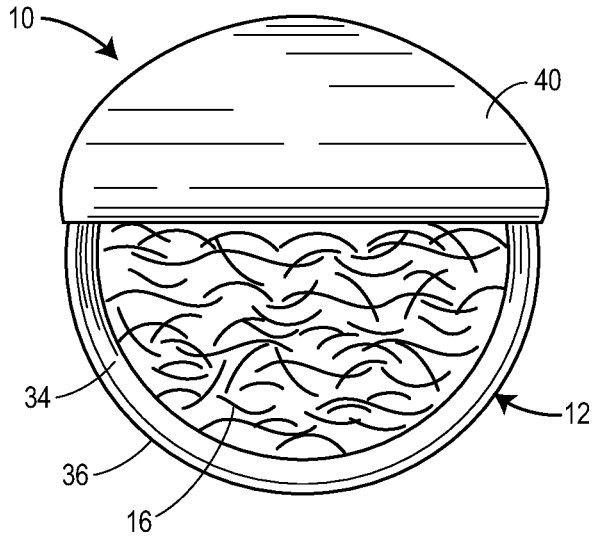
FIG. 2 is a top view of the packaged product of FIG. 1 with its removable lid 40 partially peeled back.

As shown in FIGS. 1 and 2, the cooking container 12 may have a geometric shape similar to that of an inverted truncated cone. As such, the opening 38 may be circular and the annular sidewall 34 may be slanted outwardly relative to the vertical direction. Other geometric shapes are possible including, for example, a cylinder, a rectangular prism, a hemisphere, a non-symmetrical three-dimensional geometric shape, among others. In some embodiments, the annular sidewall 34, in whole or in part, may be slanted inwardly relative to the vertical direction, for example, for gripping and/or decorative purposes.

The body 30 of the cooking container 12 may be made of a rigid, water-insoluble material and have a melting, glass transition, and/or crystallization point above that of the temperature of the water added or heated water temperature anticipated during preparation. Accordingly, the cooking container 12 may retain its shape during cooking of the food products 16 and 20 with boiling water (100° C.). In some embodiments, the material used for the body 30 may be biodegradable. Non-limiting examples of suitable materials for the body 30 include laminated paper, laminated cardboard, polystyrene, polystyrene foam, biodegradable plastics, aluminum, and steel, among others. The removable lid 40 may be made of the same or a relatively more flexible material than the material used for the body 30 so that the consumer can peel away the removable lid 40, as shown in FIG. 2, without deforming the body 30.

In addition to providing a receptacle in which the first and second food products 16 and 20 can be cooked, the cooking container 12 may also serve a protective packaging for the first and second food products 16 and 20 during storage and distribution. Additionally, the cooking container 12 may have a decorative exterior surface providing the trade dress for the packaged product 10.

Still referring to FIG. 1, the first food product 16 may partially or almost entirely fill the interior volume 14 of the cooking container 12. As compared to the second food product 20, the first food product 16 may occupy a substantially larger portion (e.g., a majority) of the interior volume 14 of the cooking container 12. In some embodiments, the first food product 16 may be a dehydrated food product which is reconstituted (e.g. rehydrated, and optionally cooked) by the addition of hot or boiling water, or in other embodiments by addition of cold or room temperature water. As used herein, "room temperature water" refers to water having a temperature in a range of approximately (e.g., ±10%) 20 to 22° C. In some embodiments, it may only take several minutes or seconds for the first food product 16 to be cooked or rehydrated with boiling or hot water. In some embodiments, the first food product 16 may include a dough-based product such as noodles, instant noodles, Ramen noodles, etc. Alternatively, or additionally, the first food product 16 may include rice, instant rice, soup, instant soup, dehydrated vegetables, dehydrated fruit, and/or dehydrated meat.

The second food product 20 may be contained entirely within the packet 18 and thus prevented from mixing or otherwise interacting with the first food product 20 prior to cooking. In some embodiments, the second food product 20 may function as a flavoring agent that modifies the taste of the first food product 16. In other embodiments, the second food product 20 may function as a texture-modifying agent that modifies the texture of the first food product 16. In additional embodiments, the second food product 20 may function as a cooking agent that modifies cooking characteristics of the first food product 16. The second food product 20 may have one or more of the aforementioned properties. The second food product 20 may be in the form of a powder, solid, gelatin, or liquid, for example. The second food product 20 can be selected to have a target dissolution rate. The second food product 20 can also be selected based on its taste, texture, or cooking modification profile, alone or in combination with the first food product 16. Non-limiting examples of the second food product 20 include seasoning (e.g., salt, sugar, pepper, spices, or any combination thereof), oil (e.g., palm oil, sesame oil, olive oil, etc.), butter, liquid-based soup, egg, milk (powdered or liquid), protein (soy or milk based), soluble fiber, vitamins, or any combination of the foregoing.

As illustrated in FIG. 1, the packet 18 may be positioned beneath the first food product 16. In some embodiments, the packet 18 may be positioned in direct contact with the bottom wall 32 of the cooking container 12. By positioning the packet 18 at or near the bottom wall 32 of the cooking container 12, the packet 18 may be partially or completely obscured from view by the first food product 16 and allow for submersion of the packet when fluids are added to the cooking container 12. Accordingly, the packet 18 may not be revealed to the consumer when the removable lid 40 is removed and an improved environment for dissolution of the packet 18 and dispersion of the second food product 20 is provided.

Still referring to FIG. 1, the packet 18 may be adhered to a wall of the container 12 by an adhesive 42, for example the bottom wall 32 and/or the side wall 34. In some embodiments, the adhesive 42 may be water-soluble. In some embodiments, adhesive 42 may be edible. For example, the adhesive 42 can be a. polyvinyl alcohol (PVOH)-based adhesive, so that upon addition of water to the cooking container 12 the adhesive 42 dissolves. The adhesive 42 may help prevent the packet 18 from migrating to the top of the cooking container 12 as the result of jostling and/or vibrations experienced by the packaged product 10 during shipping and/or distribution. Accordingly, the adhesive 42 may help keep the packet 18 hidden beneath the first food product 16. In alternative embodiments, the packet 18 may not be adhered to the cooking container 12.

Figure 3:
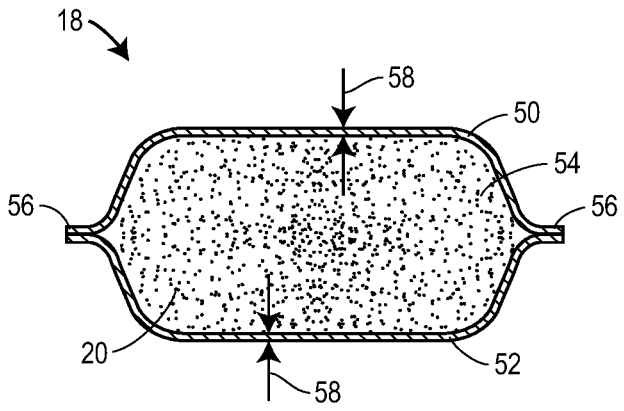
FIG. 3 is an enlarged cross-sectional view of a packet 18 illustrated in FIG. 1.

Referring now to FIG. 3, the packet 18 may enclose the second food product 20 in a single compartment or in multiple compartment of the same packet and may be formed of one or more layers of a water-soluble film. The water-soluble film can be edible, in addition to being water-soluble. In some embodiments, the water-soluble film is one of the commercially modified PVOH based films sold by MonoSol LLC under the tradename Vivos® films. The water-soluble film also may be one or more of the films described in U.S. Patent Application Publication No. 2014/0199460, the entirety of which is hereby expressly incorporated by reference.

The embodiment of the packet 18 illustrated in FIG. 3 is formed by an upper layer 50 of a water-soluble film and a lower layer 52 of a water-soluble film. The upper and lower layers 50 and 52 may be sealed together around a perimeter 56 of the packet 18 using, for example, an adhesive, heat sealing, vibration welding, ultrasonic welding, solvent welding, or any combination thereof. The interior volume 54 of the packet may be in a range of approximately (e.g., ±10%) 1.25 mL to 30 mL, or 15 mL to 30 mL, or 25 mL to 30 mL, or 1.25 mL to 15 mL. The interior volume 54 will be dependent upon the second food product selection. Stronger flavored materials (e.g., spicy materials) will require less volume than more subtle flavors (e.g., fish, herbs and the like) or bulkier materials (e.g., dehydrated vegetables).

Each of the upper and lower layers 50 and 52 may have a thickness 58 in a range of approximately (e.g., ±10%) 10 to 60 μm, or 20 to 50 μm, or 25 to 45 μm, or 30 to 45 μm, or 33 to 43 μm, or 35 to 40 μm, or 38 μm. The thickness 58 may be chosen depending on one or more factors including, for example, a target dissolution rate or time of the packet 18 in water, the ability of the second food product 20 to degrade the water-soluble film, and/or other factors impacting stability, dissolution profile and strength of the film. Preferably, the water-soluble film has a thickness 58 so that the entirety of the packet 18 dissolves when water is added to the cooking container 12, and so that no residual, visible pieces of the packet 18 remain in the cooking container 12 after cooking. Also, to ensure that the entirety of the packet 18 dissolves, the total weight of the packet 18 (excluding the weight of the second food product 20) may be in a range of approximately (e.g., ±10%) 0.1 mg to 15 g. The total weight of the packet 18 will be dependent upon the selection of the second food product selection. Dried materials such as dehydrated food products will be relatively lower in weight while denser materials (e.g., oil) will be relatively higher in total weight.

Various potential compositions of the water-soluble film are described in more detail below under the section heading entitled "Water-Soluble Films."

A method of using the packaged product 10 will now be described. Initially, the consumer may detach or remove the removable lid 40 from the body 30. Since the packet 18 may be hidden beneath the first food product 16, the consumer may be unable to see the packet 18, and therefore may not attempt to remove the packet 18 from the cooking container 12. Next, the consumer may add water, or another edible and/or cooking fluid, to the interior volume 14 of the cooking container 12 submerging the packet 18 and trapping the packet 18 between the first food product 16 and the bottom wall 32 dissolution of the packet 18 and dispersion of the second food product 18. In some embodiments, the added water is boiling or above room temperature, so that further addition of energy to the cooking container 12 is unnecessary. In other embodiments, room temperature or even cold water may be added to the interior volume 14 of the cooking container 12. In such embodiments, the cooking container 12 may subsequently be subjected to further energy (e.g., a microwave, an oven, a stove, etc.) to bring the water to a boil.

During the heating process, the water may dissolve the water-soluble film of the packet 18. As a result, the second food product 20 is released from the packet 18 and mixes and/or physically interacts with the first food product 16. This step may modify the flavor and/or cooking characteristics of the first food product 16. As mentioned above, in a preferred embodiment the water-soluble film(s) used to construct the packet 18 may have a thickness 58 and/or total weight causing the packet 18 to dissolve completely in the water, so that no visible residual pieces of the packet 18 remain upon the completion of the process. Finally, the consumer may eat the first and second food products 16 and 20, which may be combined into a finished food product as a result of the process.

Figure 4:
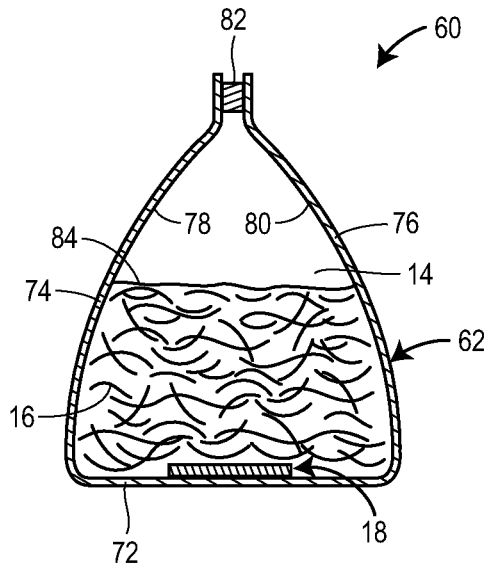
FIG. 4 is a cross-sectional view of another embodiment of a packaged product 60 constructed in accordance with principles of the present disclosure.

While the packaged product 10 of the present embodiment employs the removable lid 40 to cover the open end 38 of the cooking container 12, in alternative embodiments, the removable lid may be omitted, such as the embodiment of a packaged product 60 illustrated in FIG. 4. Here, the packaged product 60 includes a cooking container 62 formed by a flattened rigid bottom wall 72 and first and second flexible sidewalls 74 and 76. The first and second flexible sidewalls 74 and 76 each extend upwardly from the rigid bottom wall 72.

In some embodiments, an upper end of an inner surface 78 of the first flexible sidewall 74 sealingly engages and/or is connected directly to an upper end of an inner surface 80 of the second flexible sidewall 76. In some embodiments, the seal may be accomplished using, for example, an adhesive, heat sealing, vibration welding, ultrasonic welding, solvent welding, or any combination thereof. This seal may be permanently broken by a consumer by pulling the first and second flexible sidewalls 74 and 76 away from each other. In other embodiments, such as the one illustrated in FIG. 4, the upper end of the inner surface 78 of the first flexible sidewall 74 may be connected directly to the upper end of the inner surface 80 of the second flexible sidewall 76 by a resealing mechanism 82. When engaged, the resealing mechanism 82 may inhibit or prevent water 84 or other liquid inside the cooking container 62 from leaking through the upper end of the cooking container 62. The resealing mechanism may include interlocking plastic strips and/or projections (not illustrated) disposed on one or both of the inner surface 78 of the first flexible sidewall 74 and the inner surface 80 of the second flexible sidewall 76. A slider (not illustrated) may be provided on the outside of the cooking container 62 which can be slid back-and-forth to engage and disengage the interlocking plastic strips and/or projections. Accordingly, the cooking container 62 can be repeatedly opened and closed by the consumer. This may provide the consumer the ability to reseal the cooking container 62 after eating a portion of the cooked first and second food products 16 and 20 and store the leftovers for later consumption.

Water-Soluble Films

Set forth below are various exemplary compositions of water-soluble films used to construct the packet 18. Some or all of the compositions described below may be safe for human consumption.

In some embodiments, the water-soluble films may comprise a water-soluble mixture of a first water-soluble polymer, a polymer compatibilizer (e.g., a cellulose ether polymer or a modified starch), and a sugar alcohol plasticizer that is a solid at room temperature. Optionally, the water-soluble films may be edible. In at least one embodiment, the water-soluble films are transparent and may have the ability to maintain their transparency for long periods of time. The water-soluble films of the disclosure herein can have one or more other, optional advantages including thermoformability (e.g., into packets) and suitable toughness for use as packaging materials. For example, optional edible embodiments can be designed according to the disclosure herein to have suitable robustness, for example, for use as packaging. In particular, water-soluble films according to one class of embodiments of the disclosure can demonstrate unexpectedly advantageous tear strength and further optionally an unexpectedly advantageous solubility.

As used herein, the term "comprising" indicates the potential inclusion of other agents, elements, steps, or features, in addition to those specified.

As used herein and unless specified otherwise all measurements of PVOH viscosity in centipoise (cP) are of a 4% solution at 20° C., and all measurements of carboxymethyl cellulose viscosity are of a 2% solution at 25° C.

As used herein, "substantial transparency" refers to a water-soluble film that, when cast to a thickness of approximately (e.g., ±10%) 2.0 mm, has a measured opacity of approximately (e.g., ±10%) 37.0% or less, as determined by an X-RITE SP60 Series Sphere Spectrophotometer X-64 colorimeter as described herein, or substantial equivalent, after storing for at least 30 days.

As used herein, "Δ % opacity" refers to the change in opacity, as determined by an X-RITE SP60 Series Sphere Spectrophotometer X-64 colorimeter as described herein, or substantial equivalent, between the opacity of a film at t=0 after film forming, and the opacity of the same film after conditioning and storage.

As used herein, "enhanced transparency" refers to a water-soluble film according to the disclosure herein that, when cast to a thickness of approximately (e.g., ±10%) 2.0 mils, demonstrates an opacity of 37.0% or less, as determined by an X-RITE SP60 Series Sphere Spectrophotometer X-64 colorimeter as described herein, or substantially equivalent, optionally after storing for at least 30 days.

As used herein, "favorable solubility" refers to a film according to the disclosure herein that, at approximately (e.g., ±10%) 2.0 mils in thickness, completely dissolves in less than 50 seconds, preferably less than 40 and most preferably less than 30 seconds in water at 23° C. regardless of the thickness intended for use.

As used herein, "good tear strength" refers to a tear strength of at least 400 g/mil at 23° C.+/−3° C. and relative humidity (RH) in a range of 35% RH+/−5% as measured by an Elmdorf Tearing Tester model number 40043, or equivalent, in accordance with MSTM 107RD Standard Test Method for Propagation Tear Resistance of Polyvinyl Alcohol Film.

As used herein and unless specified otherwise, the terms "wt. %" and "wt %" are intended to refer to the composition of the identified element in "dry" (non water) parts by weight of the entire film (when applicable) or parts by weight of the entire composition enclosed within a pouch (when applicable). As used herein and unless specified otherwise, the term "phr" is intended to refer to the composition of the identified element in parts per one hundred parts water-soluble PVOH resins.

Water-soluble films, optional ingredients for use therein, and methods of making the same are well known in the art. In one class of embodiments, the water-soluble film includes polyvinyl alcohol (PVOH). PVOH is a synthetic resin generally prepared by the alcoholysis, usually termed hydrolysis or saponification, of polyvinyl acetate. Fully hydrolyzed PVOH, wherein virtually all the acetate groups have been converted to alcohol groups, is a strongly hydrogen-bonded, highly crystalline polymer which dissolves only in hot water—greater than approximately (e.g., ±10%) 140° F. (60° C.). If a sufficient number of acetate groups are allowed to remain after the hydrolysis of polyvinyl acetate, the PVOH polymer then being known as partially hydrolyzed, it is more weakly hydrogen-bonded and less crystalline and is soluble in cold water—less than approximately (e.g., ±10%) 50° F. (10° C.). An intermediate cold/hot water soluble film can include, for example, intermediate partially-hydrolyzed PVOH (e.g., with degrees of hydrolysis of approximately (e.g., ±10%) 94% to approximately (e.g., ±10%) 98%), and is readily soluble only in warm water—e.g., rapid dissolution at temperatures of approximately (e.g., ±10%) 40° C. and greater. Both fully and partially hydrolyzed PVOH types are commonly referred to as PVOH homopolymers although the partially hydrolyzed type is technically a vinyl alcohol-vinyl acetate copolymer.

The degree of hydrolysis (DH) of the PVOH included in the water-soluble films of the present disclosure can be approximately (e.g., ±10%) 75% to approximately (e.g., ±10%) 99%. As the degree of hydrolysis is reduced, a film made from the resin will have reduced mechanical strength but faster solubility at temperatures below approximately (e.g., ±10%) 20° C. As the degree of hydrolysis increases, a film made from the resin will tend to be mechanically stronger and the thermoformability will tend to decrease. The degree of hydrolysis of the PVOH can be chosen such that the water-solubility of the resin is temperature dependent, and thus the solubility of a film made from the resin, compatibilizer polymer, and additional ingredients is also influenced. In one class of embodiments the film is cold water-soluble. A cold water-soluble film, soluble in water at a temperature of less than 10° C., can include PVOH with a degree of hydrolysis in a range of approximately (e.g., ±10%) 75% to approximately (e.g., ±10%) 90%, or in a range of approximately (e.g., ±10%) 80% to approximately (e.g., ±10%) 90%, or in a range of approximately (e.g., ±10%) 85% to approximately (e.g., ±10%) 90%. In another class of embodiments the film is hot water-soluble. For example, a hot water-soluble film is advantageous for applications such as the packets enclosing a second food product as described herein. A hot water-soluble film, soluble in water at a temperature of at least approximately (e.g., ±10%) 60° C., can include PVOH with a degree of hydrolysis of at least approximately (e.g., ±10%) 98%.

Other film-forming, water soluble resins for use in addition to or in an alternative to PVOH can include, but are not limited to modified polyvinyl alcohols, polyacrylates, water-soluble acrylate copolymers, polyvinyl pyrrolidone, pullulan, water-soluble natural polymers including, but not limited to, guar gum, xanthan gum, carrageenan, and starch, water-soluble polymer derivatives including, but not limited to, ethoxylated starch and hydroxypropylated starch, copolymers of the forgoing and combinations of any of the foregoing.

The water-soluble polymers can be included in the film composition in an amount in a range of approximately (e.g., ±10%) 30 wt. % to approximately (e.g., ±10%) 90 wt. %, for example. The weight ratio of the amount of the water-soluble polymer as compared to the combined amount of all plasticizers, compatibilizing agents, and secondary additives can be in a range of approximately (e.g., ±10%) 0.5 to approximately (e.g., ±10%) 9, approximately (e.g., ±10%) 0.5 to approximately (e.g., ±10%) 5, or approximately (e.g., ±10%) 1 to 3, or approximately (e.g., ±10%) 1 to 2, for example.

Water-soluble polymers for use in the films described herein (including, but not limited to PVOH polymers) can be characterized by a viscosity in a range of approximately (e.g., ±10%) 3.0 to approximately (e.g., ±10%) 27.0 cP, or approximately (e.g., ±10%) 3.0 cP to approximately (e.g., ±10%) 15 cP, or approximately (e.g., ±10%) 6.0 to approximately (e.g., ±10%) 10.0 cP. The viscosity of a PVOH polymer is determined by measuring a freshly made solution using a Brookfield LV type viscometer with UL adapter as described in British Standard EN ISO 15023-2:2006 Annex E Brookfield Test method. It is international practice to state the viscosity of 4% aqueous polyvinyl alcohol solutions at 20° C. All viscosities specified herein in cP should be understood to refer to the viscosity of 4% aqueous polyvinyl alcohol solution at 20° C., unless specified otherwise.

It is well known in the art that the viscosity of a PVOH polymer is correlated with the weight average molecular weight ($\overline{M}w$) of the same PVOH polymer, and often the viscosity is used as a proxy for $\overline{M}w$. Thus, the weight average molecular weight of the water-soluble polymer can be in a range of approximately (e.g., ±10%) 30,000 to approximately (e.g., ±10%) 175,000, or approximately (e.g., ±10%) 30,000 to approximately (e.g., ±10%) 100,000, or approximately (e.g., ±10%) 55,000 to approximately (e.g., ±10%) 80,000.

In one class of embodiments, the molecular weight of the water-soluble polymer is in the range of approximately (e.g., ±10%) 55,000 to approximately (e.g., ±10%) 80,000. Unexpectedly, a water-soluble film according to the disclosure comprising polymers with molecular weights in the range of approximately (e.g., ±10%) 55,000 to approximately (e.g., ±10%) 80,000, demonstrate enhanced transparency properties. If the molecular weight of the water-soluble polymer is too high, the resulting water-soluble film does not maintain substantial transparency.

In one type of embodiment, a water-soluble film including a mixture of PVOH (e.g., approximately (e.g., ±10%) 87.7% hydrolyzed) having a 4% solution viscosity of approximately (e.g., ±10%) 8 cps and 10 phr of sorbitol can demonstrate substantial transparency for 30 days. In contrast, a water-soluble film including a mixture of PVOH (approximately (e.g., ±10%) 87.7% hydrolyzed) having a viscosity of 23 cps and 10 phr of sorbitol demonstrates substantial transparency for only 4 days.

In some embodiments, the water-soluble films of the present disclosure can include a compatibilizing agent for the sugar alcohol plasticizer that is a solid at room temperature. As used herein, a "compatibilizing agent" is a component that when included in the water-soluble film in a range of approximately (e.g., ±10%) 15 phr to approximately (e.g., ±10%) 20 phr (a ratio of approximately (e.g., ±10%) 2:1 to approximately (e.g., ±10%) 1:2 to the sugar alcohol plasticizer that is a solid at room temperature), results in the water-soluble film maintaining transparency at a sugar alcohol loading that would otherwise cause the water-soluble film to lose transparency. For example, a water-soluble film including a compatibilizing agent is able to maintain a Δ % opacity of 2.0% or less for a longer time period than an otherwise identical film that does not include the compatibilizing agent. The compatibilizing agent can be included in the water-soluble films of the present disclosure in a range of approximately (e.g., ±10%) 10 phr to approximately (e.g., ±10%) 25 phr, or in a range of approximately (e.g., ±10%) 13 phr to approximately (e.g., ±10%) 22 phr, or in a range of approximately (e.g., ±10%) 15 phr to approximately (e.g., ±10%) 20 phr. As the amount of compatibilizing agent included in the water-soluble film is reduced, the water-soluble film tends to lose transparency. As the amount of compatibilizing agent included in the water-soluble film is increased, the water-soluble film becomes more brittle and has slower dissolution times.

Suitable compatibilizers include, but are not limited to, cellulose ethers such as methylcellulose, hydroxypropyl methylcellulose, carboxymethyl cellulose, salts thereof, polysaccharides of pectin, polysaccharides of sodium alginate, modified starches such as acid-modified, hydroxypropylated starches (e.g., Pure-Cote B760 or B790 available from Grain Processing Corporation, Muscatine, Iowa), hydroxyethyl starches (e.g., Ethylex 2035 available from Tate & Lyle Ingredients Americas LLC, 2200 E. Eldorado Street, Decater, Ill.), and combinations of any of the foregoing. In one class of embodiments, the compatibilizer comprises sodium carboxymethyl cellulose (CMC). The degree of substitution of the CMC can be from approximately (e.g., ±10%) 0.60 to approximately (e.g., ±10%) 0.95, for example. As used herein, "degree of substitution" refers to the number of hydroxyl groups that have been substituted with a sodium carboxymethyl group ($CH_2COO$ (Na)) per monomer unit. In one type of embodiment, the viscosity of a 2% aqueous solution of CMC is in a range of approximately (e.g., ±10%) 20 to approximately (e.g., ±10%) 80 cP, as measured at 25° C. on a Brookfield LVT viscometer. In another class of embodiments, the compatibilizer comprises a hydroxypropylated starch. In one type of embodiment, the hydroxypropylated starch can have a 9.1% moisture content, a pH of approximately (e.g., ±10%) 6.3, an ash content of 0.20 wt. % and a protein content of 0.173 wt. %. In another class of embodiments, the compatibilizing agent comprises a hydroxyethyl starch. The level of ethoxylation can be from approximately (e.g., ±10%) 2 wt. % to approximately (e.g., ±10%) 3 wt. %, for example, as the total weight of the substituent units divided by the total weight of the polymer.

Water-soluble films according to the present disclosure further include sugar alcohol plasticizers that are solids at room temperature. Sugar alcohol plasticizers that are solid at room temperature include, but are not limited to, isomalt, maltitol, sorbitol, xylitol, erythritol, adonitol, dulcitol, pentaerythritol, mannitol and combinations thereof. Suitable sugar alcohols are available from Rochem Intl. (Ronkonkoma, N.Y.), Roquette (Lestrem, France), and Sigma-Aldrich Co, LLC (St. Louis, Mo.).

Sugar alcohol plasticizers that are solid at room temperature can be included in the water-soluble films of the present disclosure in an amount in a range of approximately (e.g., ±10%) 5 phr to approximately (e.g., ±10%) 35 phr, or approximately (e.g., ±10%) 5 phr to approximately (e.g., ±10%) 25 phr, or approximately (e.g., ±10%) 10 phr to approximately (e.g., ±10%) 25 phr, or approximately (e.g., ±10%) 10 phr to approximately (e.g., ±10%) 25 phr, for example 10 phr, 15 phr, 20 phr, 25 phr, or 30 phr. A sugar alcohol plasticizer that is a solid at room temperature can be present in the water-soluble films of the present disclosure in an amount such that the ratio of compatibilizing agent to sugar alcohol plasticizer that is a solid at room temperature is in a range of approximately (e.g., ±10%) 2:1 to 1:2, for example approximately (e.g., ±10%) 2:1, approximately (e.g., ±10%) 1.9:1, approximately (e.g., ±10%) 1.8:1, approximately (e.g., ±10%) 1.7:1, approximately (e.g., ±10%) 1.6:1, approximately (e.g., ±10%) 1.5:1, approximately (e.g., ±10%) 1.4:1, approximately (e.g., ±10%) 1.3:1, approximately (e.g., ±10%) 1.2:1, approximately (e.g., ±10%) 1.1:1, approximately (e.g., ±10%) 1:1, approximately (e.g., ±10%) 0.9:1, approximately (e.g., ±10%) 0.8:1, approximately (e.g., ±10%) 0.7:1, approximately (e.g., ±10%) 0.6:1 and/or approximately (e.g., ±10%) 0.5:1. In some embodiments, as the amount of sugar alcohol included in the water-soluble film increases, the transparency of the water-soluble film becomes more negatively affected. As the amount of sugar alcohol included in the water-soluble film is reduced, the solubility of the water-soluble film becomes negatively affected. That is, for example, at a constant temperature a film of equal thickness will take longer to dissolve.

In one class of embodiments, the sugar alcohol plasticizer that is a solid at room temperature comprises two or more sugar alcohol plasticizers that are solids at room temperature. The two or more sugar alcohol plasticizers can be included in the film composition in any relative amounts. For example, the two or more sugar alcohol plasticizers can be included in the film composition in equal amounts, or one of the sugar alcohol plasticizers that is a solid at room temperature can be a minor impurity in another sugar alcohol plasticizer as provided by a commercial supplier. In another type of embodiment, the sugar alcohol plasticizer that is a solid at room temperature will include one that has a relatively high heat of fusion (e.g. above 247 J/g, or above 192 J/g) and a second one that has a relatively low heat of fusion (e.g. 247 J/g or less, or 192 J/g or less, respectively).

In one class of embodiments, the sugar alcohol plasticizer that is a solid at room temperature is selected from the group consisting of isomalt, maltitol, sorbitol, xylitol, adonitol, mannitol, and combinations thereof, and further optionally the ratio of compatibilizing agent to sugar alcohol present in the water-soluble film is approximately (e.g., ±10%) 2:1. As described below, water-soluble film according to this class of embodiments (including the described ratio of compatibilizing agent to sugar alcohol), cast to approximately (e.g., ±10%) 2.0 mils thick, maintained a Δ % opacity of 2.0% or less for at least 4 days longer than water-soluble films of a similar composition except with no compatibilizing agent included, or at least 21 days longer, or at least 25 days longer.

In another class of embodiments, the sugar alcohol plasticizer that is a solid at room temperature is selected from the group consisting of isomalt, maltitol, sorbitol, xylitol, adonitol, and combinations thereof, and further optionally the ratio of compatibilizing agent to sugar alcohol present in the water-soluble film is less than 2:1. Water-soluble films according to this class of embodiments (including the described ratio of compatibilizing agent to sugar alcohol), cast to approximately (e.g., ±10%) 2.0 mils thick, were shown to maintain a Δ % opacity of 2.0% or less for at least 12 days longer than water-soluble films of a similar composition except with no CMC included, or at least 19 days longer, or at least 23 days longer, or at least 28 days longer.

Unexpectedly, there was found to be no correlation between the number of carbons, molecular weight, or structure (linear vs cyclic or structural isomers) of the sugar alcohol and the compatibilization of the sugar alcohol by the compatibilizing agent. That is, the transparency enhancement of the water-soluble films that include the compatibilizing agent could not be predicted based on the number of carbons, molecular weight, or structure (linear vs. cyclic or structural isomers) of the sugar alcohol. As mentioned above, "enhanced transparency" as used herein refers to a water-soluble film that demonstrates an opacity of 37.0% or less as measured by a spectrophotometer, for example, 36.8% or less, or 36.6% or less. Unacceptable amounts of cloudiness of the water-soluble film results when a water-soluble film has an opacity of 37.2% or more, 37.3% or more, or 37.4% or more. More unexpectedly, the ability of a given compatibilizing agent/sugar alcohol combination to result in a water-soluble film with enhanced transparency (relative to a film with the same sugar alcohol and no compatibilizing agent) can be predicted based on the heat of fusion of the sugar alcohol. In one class of embodiments enhanced transparency is demonstrated when a sugar alcohol plasticizer that is a solid at room temperature characterized by a heat of fusion of approximately (e.g., ±10%) 247 J/g or less is included in a water-soluble film in an amount of approximately (e.g., ±10%) 20 phr or less, with a compatibilizing agent. Suitable sugar alcohol plasticizers that demonstrate enhanced transparency when included in a water-soluble film with a compatibilizing agent in an amount of approximately (e.g., ±10%) 20 phr or less can include, consist essentially of, or can consist of one or more of isomalt, maltitol, sorbitol, adonitol, and xylitol, and combinations thereof. For example, it was shown that a water-soluble film comprising 10 phr of xylitol, having a heat of fusion of 247 J/g, demonstrated an opacity of 36.6 after 30 days. In contrast, a water-soluble film comprising 10 phr of pentaerythritol, having a heat of fusion of 289 J/g, demonstrated an opacity of 38.6 after 30 days and had an undesirable cloudiness. In another, non-exclusive class of embodiments enhanced transparency is demonstrated when a sugar alcohol plasticizer that is a solid at room temperature characterized by a heat of fusion of approximately (e.g., ±10%) 247 J/g or less and has at least two adjacent, non sterically hindered hydroxyl groups in a common plane is included in a water soluble film in an amount of approximately (e.g., ±10%) 20 phr or less. Without intending to be bound by theory, it is believed that the at least two sterically unhindered adjacent hydroxyl groups in a common plane favors the hydrogen bonding of the hydroxyls of the sugar alcohol with the hydroxyls of PVOH. Further, without intending to be bound by theory, it is believed that the hydrogen bonding interactions of the sugar alcohol with the PVOH stabilizes the sugar alcohols in the film formulation, allowing for a greater loading of the sugar alcohols characterized by a heat of fusion of 247 J/g or less. In another class of embodiments, enhanced transparency is demonstrated when a sugar alcohol plasticizer that is a solid at room temperature characterized by a heat of fusion of approximately (e.g., ±10%) 192 J/g or less is included in a water-soluble film in an amount of approximately (e.g., ±10%) 25 phr to approximately (e.g., ±10%) 35 phr, or approximately (e.g., ±10%) 30 phr, with a compatibilizing agent. Suitable sugar alcohol plasticizers that demonstrate enhanced transparency when included in a water-soluble film with a compatibilizing agent in an amount of approximately (e.g., ±10%) 25 phr to approximately (e.g., ±10%) 35 phr, or approximately (e.g., ±10%) 30 phr include, but are not limited to, isomalt, sorbitol, and combinations thereof. For example, it was shown that a water-soluble film comprising 30 phr of sorbitol, having a heat of fusion of 192 J/g demonstrated an opacity of 35.7 after 30 days. In contrast, a water-soluble film comprising 30 phr of adonitol, having a heat of fusion of 232 J/g, had an opacity of 42.4 after 30 days and had an undesirable cloudy appearance. In another, non-exclusive class of embodiments enhanced transparency is demonstrated when a sugar alcohol plasticizer that is a solid at room temperature characterized by a heat of fusion of approximately (e.g., ±10%) 192 J/g or less and has at least two adjacent, non sterically hindered hydroxyl groups in a common plane is included in a water soluble film in an amount of approximately (e.g., ±10%) 25 phr to approximately (e.g., ±10%) 35 phr, for example 30 phr. Without intending to be bound by theory, it is believed that the at least two sterically unhindered adjacent hydroxyl groups in a common plane favors the hydrogen bonding of the hydroxyls of the sugar alcohol with the hydroxyls of PVOH.

Further, without intending to be bound by theory, it is believed that the hydrogen bonding interactions of the sugar alcohol with the PVOH stabilizes the sugar alcohols in the film formulation, allowing for a greater loading of the sugar alcohols characterized by a heat of fusion of 192 J/g or less.

In one class of embodiments, the water-soluble film includes a mixture of PVOH, CMC, xylitol, and sorbitol. The CMC to xylitol ratio can be 3:1, for example, while the ratio of compatibilizing agent to total sugar alcohol plasticizer that is a solid at room temperature is in the range of approximately (e.g., ±10%) 2:1 to 1:2. Unexpectedly, a water-soluble film comprising a 3:1 CMC to xylitol ratio demonstrated both favorable solubility and good tear strength. As described above, when used herein, "favorable solubility" refers to a film that, at approximately (e.g., ±10%) 2.0 mils thick, completely dissolves in less than 50 seconds, preferably less than 40 and most preferably less than 30 seconds in water at 23° C. As used herein, "good tear strength" refers to a tear strength of at least 400 g/mil as measured by an Elmdorf Tearing Tester model number 40043, or equivalent as described in the Tear Strength Measurements section below. Surprisingly, a water-soluble film including a 3:1 ratio of CMC to xylitol had a faster rate of dissolution than a water-soluble film including a CMC to xylitol ratio in which the xylitol is the major component. The rate of dissolution of the water-soluble film including a 3:1 ratio of CMC to xylitol was also comparable to the rate at which a water soluble film of the same composition, except with no CMC, dissolves. The rate of dissolution of a water-soluble film comprising CMC and xylitol would be expected to decrease when the amount of CMC in the water-soluble film increased because CMC has a slower rate of dissolution than xylitol.

More unexpectedly, a water-soluble film comprising a 3:1 ratio of CMC to xylitol demonstrates an increase in tear strength relative to a water-soluble film comprising either CMC or xylitol alone. Both CMC and xylitol are known to independently reduce the tear strength of water-soluble films comprised of PVOH. The inclusion of both components in a water-soluble film would be expected to compound the individual effects, reducing the tear strength of a PVOH based water soluble film comprising to a level between the PVOH tear strength of a water-soluble film with CMC only and the PVOH tear strength of a water-soluble film with only xylitol.

The water-soluble films according to the present disclosure may include other optional additive ingredients including, but not limited to, plasticizers that are liquids at room temperature, surfactants, film formers, antiblocking agents, internal release agents and other functional ingredients, for example in amounts suitable for their intended purpose.

Water is recognized as a very efficient plasticizer for PVOH and other polymers; however, the volatility of water makes its utility limited since polymer films need to have at least some resistance (robustness) to a variety of ambient conditions including low and high relative humidity. Glycerin is much less volatile than water and has been well established as an effective plasticizer for PVOH and other polymers. Glycerin or other such liquid plasticizers by themselves can cause surface "sweating" and greasiness if the level used in the film formulation is too high. This can lead to problems in a film such as unacceptable feel to the hand of the consumer and even blocking of the film on the roll or in stacks of sheets if the sweating is not mitigated in some manner, such as powdering of the surface. This could be characterized as over plasticization. However, if too little plasticizer is added to the film the film may lack sufficient ductility and flexibility for many end uses, for example to be converted into a final use format such as pouches.

Plasticizers that are liquids at room temperature for use in water-soluble films of the present disclosure include, but are not limited to, glycerol, diglycerol, propylene glycol, ethylene glycol, diethyleneglycol, triethylene glycol, tetraethyleneglycol, polyethylene glycols up to MW 400, 2 methyl 1, 3 propane diol, lactic acid and combinations thereof. As less plasticizer is used, the film becomes more brittle, whereas as more plasticizer is used the film loses tensile strength. Plasticizers that are liquids at room temperature can be included in the water-soluble films in an amount in a range of approximately (e.g., ±10%) 25 phr to approximately (e.g., ±10%) 50 phr, or from approximately (e.g., ±10%) 30 phr to approximately (e.g., ±10%) 45 phr, or from approximately (e.g., ±10%) 35 phr to approximately (e.g., ±10%) 40 phr, for example.

Surfactants for use in water-soluble films are well known in the art. Optionally, surfactants are included to aid in the dispersion of the polymer solution upon casting. Suitable surfactants for water-soluble films of the present disclosure include, but are not limited to, dioctyl sodium sulfosuccinate, lactylated fatty acid esters of glycerol and propylene glycol, lactylic esters of fatty acids, sodium alkyl sulfates, polysorbate 20, polysorbate 60, polysorbate 65, polysorbate 80, lecithin, acetylated fatty acid esters of glycerol and propylene glycol, and acetylated esters of fatty acids, and combinations thereof. Thus, surfactants can be included in the water-soluble films in an amount of less than approximately (e.g., ±10%) 2 phr, for example less than approximately (e.g., ±10%) 1 phr, or less than approximately (e.g., ±10%) 0.5 phr, for example.

A class of embodiments of the water-soluble films according to the present disclosure is characterized by the water-soluble film being edible. In this class of embodiments the water-soluble polymers can include, can consist essentially of, or can consist of one or more of PVOH, modified PVOH, water-soluble natural polymers including, but not limited to, guar gum, xanthan gum, carrageenan, and starch, water-soluble polymer derivatives including, but not limited to, ethoxylated starch and hydroxypropylated starch, copolymers of the forgoing, and combinations of the forgoing. In one class of edible embodiments, the water-soluble polymer is included in the film composition in the lowest amount possible that will still allow the resulting film to demonstrate acceptable tear strength, solubility, tensile strength, elongation at break, and energy to break. Optional ingredients for inclusion in water-soluble films according to the disclosure include one or more of plasticizers that are liquid at room temperature, surfactants, compatibilizers, co-polymers, and co-film formers, for example. Liquid plasticizers can include, consist essentially of, or consist of one or more of glycerol, diglycerol, propylene glycol, low molecular weight polyethylene glycol (e.g., having a liquid consistency, for example having a molecular weight such as 200, 300, and 600), monoacetin, triacetin, triethyl citrate, and 1,3-butanediol. Surfactants can include, consist essentially of, or consist of dioctyl sodium sulfosuccinate, lactylated fatty acid esters of glycerol and propylene glycol, lactylic esters of fatty acids, sodium alkyl sulfates, polysorbate 20, polysorbate 60, polysorbate 65, polysorbate 80, lecithin, acetylated fatty acid esters of glycerol and propylene glycol, and acetylated esters of fatty acids, for example. Film formers can include, consist essentially of, or consist of one or more of pullulan, pectin, starch, gelatin, and sodium alginates. Other optional ingredients will be apparent to one of ordinary skill in the art in view of the present disclosure.

Components for inclusion in edible water soluble films can be those designated as "Generally Recognized as Safe" (GRAS) by the United States Food and Drug Administration, and/or components with assigned, allowable E-numbers in the European Union, and/or components that are not yet designated as GRAS or E-numbered but have gone through proper testing and have been demonstrated as safe for human consumption in the amounts proposed for use in the film.

Water-soluble films according to the present disclosure can be designed by the disclosure herein to demonstrate excellent practical toughness. As used herein, "excellent practical toughness" refers to one or more of tensile strength, elongation at break, and energy to break values that fall within the ranges described herein, optionally a combination of all three of tensile strength, elongation at break, and energy to break values. Thus, according to this aspect of the invention the water-soluble films according to the present disclosure can have a tensile strength of at least approximately (e.g., ±10%) 10 N/mm$^2$, or greater than approximately (e.g., ±10%) 12 N/mm$^2$, or greater than approximately (e.g., ±10%) 14 N/mm$^2$, or greater than approximately (e.g., ±10%) 16 N/mm$^2$ as measured on a Model 5543 Instron® Tensile Tester, or equivalent, as described in the Tensile Strength Measurement section below. The water-soluble films according to this aspect of the invention can have an elongation at break value of at least approximately (e.g., ±10%) 250%, or greater than approximately (e.g., ±10%) 300%, or greater than approximately (e.g., ±10%) 350%, or greater than approximately (e.g., ±10%) 400% as measured on a Model 5543 Instron® Tensile Tester, or equivalent, as described in the Tensile Strength Measurement section below. The water-soluble films according to this aspect of the invention can have an energy to break of at least approximately (e.g., ±10%) 0.5 J/mm$^2$, or greater than approximately (e.g., ±10%) 1.0 J/mm$^2$, or greater than approximately (e.g., ±10%) 1.23 J/mm$^2$ as measured on a Model 5543 Instron® Tensile Tester, or equivalent, as described in the Tensile Strength Measurement section below. In one class of embodiments, a water-soluble film according to the disclosure includes PVOH, a CMC compatibilizing agent and a combination of xylitol and sorbitol as the sugar alcohol plasticizer that is a solid at room temperature, with a CMC to sugar alcohol plasticizer ratio of approximately (e.g., ±10%) 1.1:1. Water-soluble films according to this embodiment demonstrate good dissolution time at 23° C., for example approximately (e.g., ±10%) 22.8 seconds, good tensile strength, for example approximately (e.g., ±10%) 21.3 N/mm$^2$, good elongation to break, for example approximately (e.g., ±10%) 467.3%, and good energy to break, for example approximately (e.g., ±10%) 1.7 J/mm$^2$. In another class of embodiments, a water-soluble film according to the disclosure includes PVOH, a modified starch compatibilizing agent and a combination of xylitol and sorbitol as the sugar alcohol plasticizer that is a solid at room temperature, with a compatibilizing agent to sugar alcohol plasticizer ratio of approximately (e.g., ±10%) 1.1:1. Water-soluble films according to this embodiment demonstrate good dissolution time at 23° C., for example approximately (e.g., ±10%) 31.4 seconds, good tensile strength, for example approximately (e.g., ±10%) 19.6 N/mm$^2$, good elongation to break, for example approximately (e.g., ±10%) 497.7%, and good energy to break, for example approximately (e.g., ±10%) 1.5 J/mm$^2$.

The water-soluble films can be formed into a water-soluble packet. Packets may be made using any suitable equipment and method, including the various methods already commonly known in the art. The water-soluble film optionally can be drawn into a suitable mold. Heat can be applied to the water-soluble film during the process, to result in a process commonly known as thermoforming. Water-soluble films according to the present disclosure are heat sealable. As used herein, "heat sealable" refers to films that when heat sealed at a temperature in a range of approximately (e.g., ±10%) 275° F. to approximately (e.g., ±10%) 300° F. (135° C. to approximately (e.g., ±10%) 150° C.) do not peel apart by hand without tearing the film and do not show any indications of degradation (i.e., browning or bubbling) when heat sealed in a TS-12 Heat Sealer available from Lako Tool & Manufacturing, Inc of Perrysburg, Ohio, or equivalent, as described in the Heat Seal Measurements section below. In one class of embodiments, the heat sealable water-soluble films have a peak load ratio (i.e. a ratio of the seal peak load to the film peak load) of at least approximately (e.g., ±10%) 0.30, at least approximately (e.g., ±10%) 0.32, at least approximately (e.g., ±10%) 0.35, or at least approximately (e.g., ±10%) 0.36 as determined by measurements taken on a Model 5543 Instron® Tensile Tester, or equivalent, as described in the Tensile Strength Measurement section below. Water-soluble films according to the present disclosure are thermoformable. As used herein, "thermoformable" refers to a water soluble film that has an elongation at approximately (e.g., ±10%) 23° C. and 35% relative humidity of at least approximately (e.g., ±10%) 250%, or at least approximately (e.g., ±10%) 300% and is heat stable.

While several of the foregoing embodiments of the water-soluble film are transparent, the scope of the present disclosure is not limited to constructing the packet 18 of a transparent film. In some embodiments, the water-soluble film used to make the packet 18 is opaque or substantially opaque. In still further embodiments, the water-soluble film may possess a color that is similar to, or exactly the same, as the color of an inner wall of the cooking container 12 or 62. In one embodiment, the water-soluble film may be white and the inner wall of the cooking container 12 or 62 may also be white. In still further embodiments, the color of the water-soluble film may be selected to match the color of the food product 16 inside the cooking container 12 or 62, so that the two are visually indistinguishable.

From the foregoing, it can be seen that the present disclosure advantageously provides instant food products, and methods of their preparation, which are more convenient and simpler for consumers to use. The instant food products according to the present disclosure advantageously include an ingredients packet which dissolves in water and which is edible to the consumer. Therefore, the consumer is not required to tear open, empty, and/or discard the ingredients packet prior to cooking the instant food product. Rather, the consumer can simply add water the packaged product.

While the invention has been described in connection with various embodiments, it will be understood that the invention is capable of further modifications. This application is intended to cover any variations, uses or adaptations of the invention following, in general, the principles of the invention, and including such departures from the present disclosure as, within the known and customary practice within the art to which the invention pertains.

What is claimed is:

1. A packaged product comprising:

a cooking container having an interior volume and an openable end;

a first food product disposed within the sealed interior volume of the cooking container; and a packet filled with a liquid food product and disposed within the sealed interior volume of the cooking container beneath at least a portion of the first food product, the packet being adhered to at least a bottom wall of the cooking container by an edible water-soluble adhesive material applied to at least a central portion of a bottom wall extending across the packet, the packet being made of an edible water-soluble film, the edible water-soluble film comprising a water-soluble mixture of polyvinyl alcohol or a modified polyvinyl alcohol, a compatibilizing agent, and a sugar alcohol plasticizer that is solid at room temperature.

2. The packaged product of claim 1, the packet being positioned beneath at least a portion of the first food product so that the packet is obscured from view by the first food product when the openable end of the cooking container is opened.

3. The packaged product of claim 1, the polyvinyl alcohol or modified polyvinyl alcohol in an amount in a range of approximately 35 to 90 wt. %, based on a total weight of the water-soluble film.

4. The packaged product of claim 3, the sugar alcohol plasticizer having a heat of fusion of approximately 247 J/g or less and a concentration in a range of approximately 5 to 35 phr.

5. The packaged product of claim 3, the sugar alcohol plasticizer having a heat of fusion in a range of approximately 192 J/g to 247 J/g and a concentration of approximately 20 phr or less.

6. The packaged product of claim 1 wherein:

the compatibilizing agent comprises carboxymethyl cellulose; and the sugar alcohol plasticizer comprises xylitol.

7. The packaged product of claim 1, the water-soluble film having a thickness in a range of approximately 33 μm to 43 μm.

8. The packaged product of claim 2, the first food product including at least one of: instant pasta, instant rice, instant soup, a dough-based food product, or a dehydrated food product.

9. The packaged product of claim 8, the liquid food product including at least one of: oil, sesame oil, palm oil, or olive oil.

10. The packaged product of claim 1, comprising:

a second packet filled with a third food product and disposed within the cooking container, the second packet being made of a water-soluble film that is edible.

11. The packaged product of claim 10, the liquid food product comprising oil and the third food product comprising a liquid flavoring agent.

12. The packaged product of claim 2, comprising a removable lid attached to and sealing close the openable end of the cooking container.

13. The packaged product of claim 2, the cooking container including:

a first sidewall and a second sidewall each extending upwardly from the bottom wall; and an inner surface of the first sidewall removably and sealingly engaging an inner surface of the second sidewall to seal close the openable end of the cooking container.

14. The packaged product of claim 13, at least one of the inner surface of the first sidewall or the inner surface of the second sidewall including a resealing mechanism so that the interior volume of the cooking container can be resealed after the cooking container is opened.

15. The packaged product of claim 2, the packet being in direct contact with at least a portion of the first food product when the cooking container is arranged in an upright position.

16. The packaged product of claim 1, the edible water-soluble film being flavorless.

17. The packaged product of claim 1, wherein the liquid food product comprises oil.

18. The packaged product of claim 1, the adhesive material being a polyvinyl alcohol based material.

19. The packaged product of claim 1, wherein the edible water-soluble adhesive material is configured to: (i) prevent the packet from moving with respect to the bottom wall of the cooking container prior to addition of water to the cooking container, and (ii) dissolve upon the addition of water to the cooking container.

20. A method of preparing an instant food product for consumption, the method comprising:

removing a lid from a cooking container containing a first food product and a packet filled with a liquid food product, wherein the packet is made of an edible water-soluble film comprising a water-soluble mixture of polyvinyl alcohol or a modified polyvinyl alcohol, a compatibilizing agent, and a sugar alcohol plasticizer that is solid at room temperature, the packet being adhered to at least a bottom wall of the cooking container by an edible water-soluble adhesive material applied to at least a central portion of a bottom wall extending across the packet; and adding a cooking fluid comprising water to the cooking container to dissolve the packet, thereby allowing the dispersion of the liquid food product with the first food product to form a finished food product.

21. The method of claim 20, wherein adding cooking fluid to the cooking container comprises adding hot water to the cooking container.

22. The method of claim 20, comprising placing the cooking container in a microwave oven for an amount of time sufficient to bring the water to a boil.

23. The method of claim 20, the packet being positioned beneath at least a portion of the first food product so that the packet is obscured from view by the first food product when the lid is removed.

* * * * *